United States Patent [19]

Thaler

[11] 4,011,421

[45] Mar. 8, 1977

[54] GAS-BLAST SWITCH

[75] Inventor: Richard Thaler, Unterentfelden, Switzerland

[73] Assignee: Sprecher & Schuh AG, Aarau, Switzerland

[22] Filed: Aug. 11, 1975

[21] Appl. No.: 603,864

[30] Foreign Application Priority Data

Aug. 14, 1974 Switzerland ..... 11121/74

[52] U.S. Cl. ..... 200/148 A

[51] Int. Cl.[2] ..... H01H 33/88

[58] Field of Search ..... 200/148 A, 148 R

[56] References Cited

UNITED STATES PATENTS

| | | | |
|---|---|---|---|
| 3,582,589 | 6/1971 | Frink | 200/148 A |
| 3,588,407 | 6/1971 | Frink | 200/148 A |
| 3,881,079 | 4/1975 | Zuckler | 200/148 A |

FOREIGN PATENTS OR APPLICATIONS

| | | | |
|---|---|---|---|
| 671,326 | 2/1939 | Germany | 200/148 R |
| 2,025,054 | 1/1971 | Germany | 200/148 A |

*Primary Examiner*—Robert S. Macon

[57] ABSTRACT

A gas-blast switch comprising two contact elements which can be brought into and out of engagement with one another, a drive means for actuating at least one of said contact elements, and a pump device consisting of a piston and cylinder actuatable in response to the switching movements of the gas-blast switch. During the cut-off movements of the gas-blast switch the pump device conveys an extinguishing agent out of a pump compartment of the pump device through a nozzle into an extinguishing or blow-out compartment or chamber, the nozzle being constructed to take-up the switching arc existing between the separating contact elements. The piston consists of a plurality of piston portions guided to be relatively displaceable in a gastight fashion within one another and dividing the piston surface confronting the pump compartment, one of the piston portions being positively connected with the drive means. Between the one piston portion positively connected with the drive means and a second piston portion and between such second piston portion and the pump cylinder there is arranged a respective releasable coupling mechanism which upon cut-off of the gas-blast switch and as a function of the pressure difference between the pump compartment and the exhaust compartment selectively positively connects the second piston portion either with the one piston portion below a pre-selected excess pressure boundary or limit prevailing in the pump compartment or with the pump cylinder when there prevail pressure values which are above the pre-selected pressure limit.

7 Claims, 4 Drawing Figures

GAS-BLAST SWITCH

BACKGROUND OF THE INVENTION

The present invention relates to a new and improved construction of gas-blast switch of the type comprising two contact elements which can be brought into and out of engagement with one another, drive means, a pump device composed of a piston and cylinder actuatable by the switching movements of the gas-blast switch wherein during the cut-off movements of the gas-blast switch the pump device conveys an extinguishing agent out of a pump compartment through a nozzle into an exhaust or blow-off compartment, the nozzle being constructed for taking-up the switching arc formed between the separating contact elements, the piston consisting of a number of piston portions guided within one another for relative movement in a gastight fashion and dividing the piston surface or face confronting the pump compartment, one of the piston portions being positively connected with the drive means.

A gas-blast switch of the previously mentioned type is taught in Swiss Pat. No. 524,886. With this construction the piston portion positively or force-lockingly connected with the drive means is surrounded by a substantially ring-shaped auxiliary piston with which there is associated an energy storage in such a manner that during the cut-off movement the auxiliary piston carries out a pre-compression stroke under the action of the energy storage, whereas charging of the energy storage occurs during the cut-on movement by form-locking entrainment of the piston portion positively or force-lockingly connected with the drive means. With this arrangement, the ringshaped auxiliary piston is only effective prior to separation of the contacts and afterwards remains stationary. In order to be able to also extinguish relatively small currents in the presence of relatively large extinquishing distances and to obtain the pressure differential between the pump compartment and the exhaust compartment needed for extinguishing of the arc, the further moved piston surface must be sufficiently large in size. This relatively large piston surface required for cutting-off small currents, during the cutting-off or relatively large currents requires considerable drive power because the nozzle in the presence of such large currents is clogged by the arc burning therein and which possesses a relatively large diameter, and thus permits of only a very small quantity of gas to flow therethrough. Due to the clogged nozzle the pressure then increases in the pump compartment, resulting in an increase of the aforementioned required drive power. If, in these situations, there is not available the necessary drive force or power then the piston portion or section positively or force-lockingly connected with the drive means and thus also the contact element connected therewith is moved back, in other words in the cut-on direction. Hence, the cut-off movement is retarded. With this movement hot gases additionally flow out of the nozzle back into the pump compartment, and the gas seal in the pump compartment decreases. If the extinguishing gas in the pump compartment possesses a smaller density then the extinguishing characteristics of the gas-blast switch are unfavorably impaired. This gas-blast switch only can be operationally reliably actuated with a relatively large and economically unfavorable drive means.

SUMMARY OF THE INVENTION

Hence, it is a primary object of the present invention to provide a new and improved construction of gas-blast switch which is not associated with the aforementioned drawbacks and limitations of the prior art constructions.

Another and more specific object of the present invention aims at the provision of a new and improved construction of gas-blast switch rendering possible both the cutting-off of small and large currents with relatively small drive power.

Still a further significant object of the present invention aims at the provision of a new and improved construction of gas-blast switch which is relatively simple in construction and design, economical to manufacture, versatile in its cut-off operations for both small and large currents while using relatively small drive power, and extremely reliable in the performance of its cut-off or switching functions.

Now in order to implement these and still further objects of the invention, which will become more readily apparent as the description proceeds, the gas-blast switch of the previously mentioned type is manifested by the features that a respective releasable coupling mechanism is arranged between the one piston portion positively or force-lockingly connected with the drive means and a second piston portion and also between the second piston portion and the pump cylinder, the respective releasable coupling mechanisms, upon cutting-off the gas-blast switch, and as a function of the pressure difference between the pump compartment and the exhaust compartment selectively positively or force-lockingly connect the second piston portion either with the one piston portion below a pre-selected excess pressure limit or boundary prevailing in the pump compartment or with the pump cylinder in the presence of pressure values above the aforesaid pre-selected limit.

The release of the connection between the one piston portion and the second piston portion and establishment of the connection between the second piston portion and the pump cylinder can occur as a function of pressure either at a predetermined or optional location in the pump cylinder.

The piston can possess a third piston portion which, when there are present pressure values in the pump compartment which are above the pre-selected excess pressure limit or boundary, disconnect the coupling mechanism between the one or first piston portion and the second piston portion and bring the third piston portion into engagement between the second piston portion and the pump cylinder. The third piston portion can be constituted by a spring-loaded pressure measuring or measurement piston. Each coupling mechanism can be constituted, for instance, by a ball locking arrangement or a friction brake.

BRIEF DESCRIPTION OF THE DRAWINGS:

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
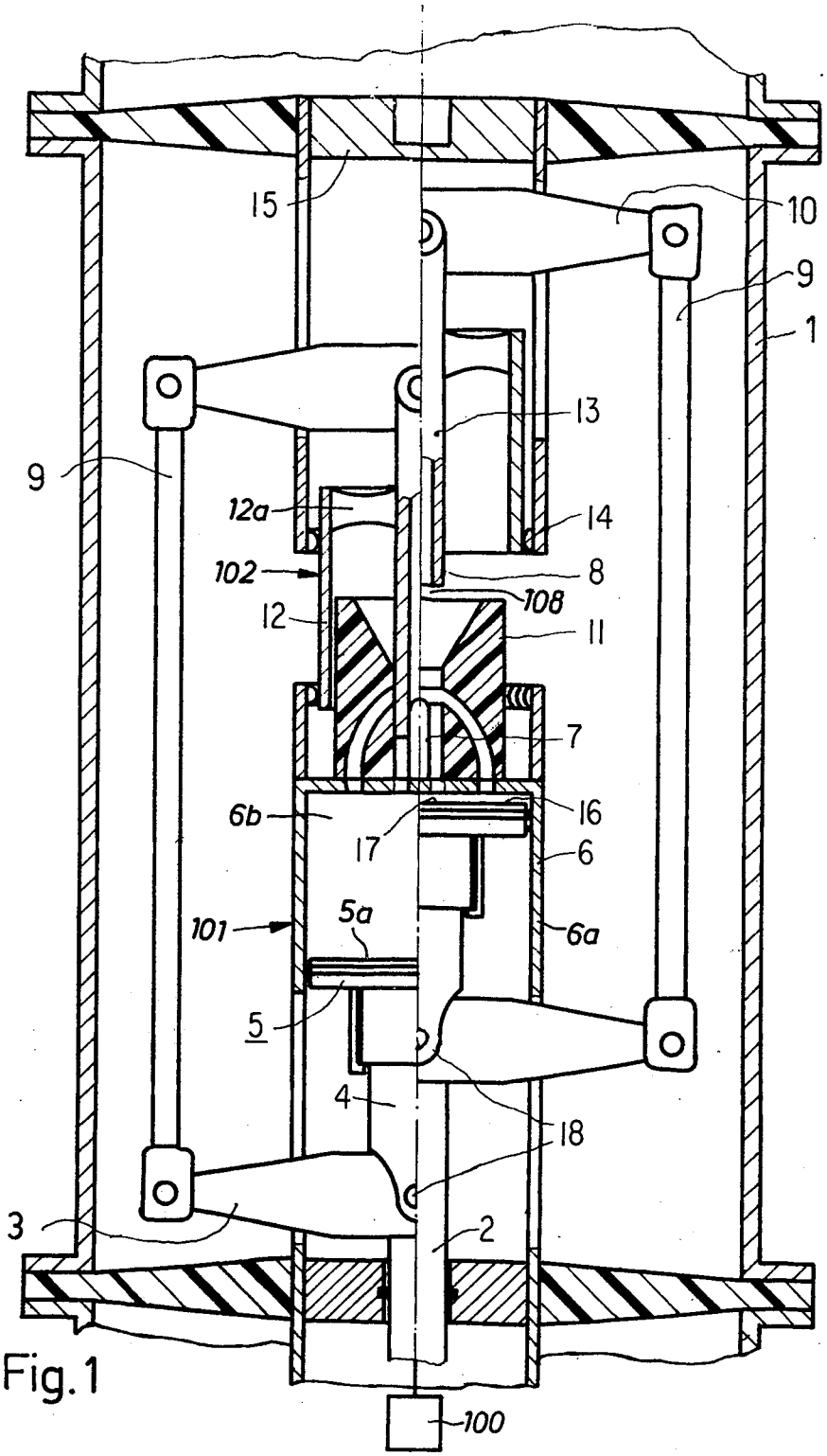
FIG. 1 is a fragmentary longitudinal sectional view of a gas-blast switch, constructed according to the teachings of the present invention.

Describing now the drawings, the exemplary embodiment of gas-blast switch shown in longitudinal sectional view in FIG. 1 is accommodated in a sealed or closed metallic housing 1 filled with an electro-negative gas, for instance sulphur hexafluoride ($SF_6$). Actuation of the gas-blast switch occurs through the agency of the drive rod 2. The drive means and the coupling of the drive means with the rod 2 has only been schematically indicated in FIG. 1 by reference character 100 since the details thereof do not constitute subject matter of the present invention. Any conventional device suitable for this purpose can be employed. The drive rod 2 is closed off by means of the transverse element 3. Hingedly connected with the center of central region of the transverse element 3 at the location 18 is an actuation rod 4 of a piston 5. This piston or piston member 5 is guided in a pump cylinder 6 and constitutes a pump mechanism of pump device 101 for the gas-blast switch. The piston 5 also can contain a check of non-return valve 105 (see FIGS. 2 and 3) or equivalent structure for facilitating the suction operation of the pump device. The one contact element 7 is fixedly connected with the pump cylinder 6. The infeed of current to the contact element 7 takes place through the wall 6*a* of the pump cylinder 6.

The second contact element 8 is actuated by means of an insulating rod 9 and a transverse element 10 due to the switching movements of the rod 2 and can be brought into and out of operative engagement or contact with the contact element 7. The contact element 7 is arranged in a blast nozzle 11 and during the cut-off movements of the gas-blast switch extinguishing gas which is delivered from the pump device 101 flows around the contact element 7 through the nozzle 11 into the exhaust compartment or chamber 108.

The contact elements 7 and 8 are bridged by a parallel disconnector or separator 102 consisting of a cylinder 12 and sliding contacts 14. The contacts 14 of the parallel disconnector 102 separate during the cut-off movements of the gas-blast switch prior to the contact elements 7 and 8 and close during the cut-on movements after the contact elements 7 and 8. The parallel separator or disconnector 102 is constructed to handle the operating current. The contact elements 7 and 8 are only used for the cut-on and cut-off of the currents. The cylinder 12 of the parallel disconnector 102 is electrically conductively connected by means of the connection member 12*a* with the actuation rod 13 of the contact element 8. By means of this cylinder 12 and the sliding contacts 14 the current is delivered from the contact element 8 to the connection or terminal location or block 15 of the gas-blast switch.

Figure 2:
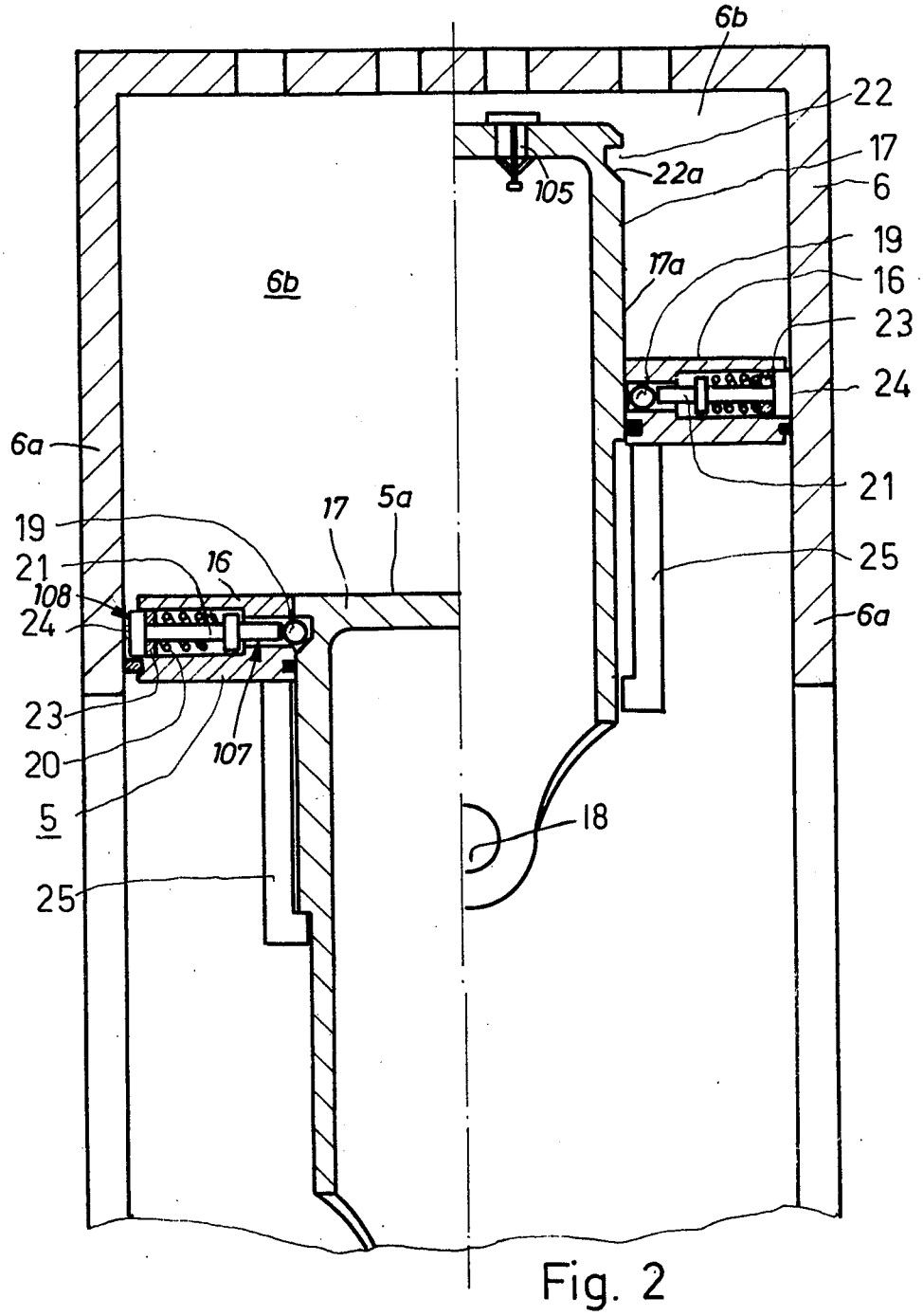
FIG. 2 is a fragmentary longitudinal sectional view of a first construction of pump device.

The piston or piston member 5 consists of two piston portions or sections 16, 17 which guided in a gastight fashion to be relatively displaceable within one another and divide the piston surface 5a confronting the pump compartment or chamber 6*b*. In FIG. 2 the piston 5 has been illustrated in section on a different scale than in the showing of FIG. 1. At the left-hand portion of the figures of the drawings the piston 5 has been illustrated during the cut-on condition of the gas-blast switch and in the right-hand portion of the figures such piston 5 has been illustrated during the cut-off condition of such gas-blast switch. The one piston portion 17 is positively or force-lockingly connected with the drive means 2, 100 via a not particularly illustrated standard bolt or the like which is guided through the hole or aperture 18 defining the connection location. During the cut-off movements of the gas-blast switch the one piston portion 17 of the piston 5 shown at the left-hand side of FIG. 2 together with the second piston portion 16 is moved upwardly. In the case of smaller cut-off currents, when the excess pressure in the pump compartment 6*b* does not exceed a predetermined value, both of the piston portions 16 and 17 remain together until reaching the cut-off position illustrated at the right-hand portion of the showing on FIG. 1.

Between the one piston portion 17 and the second piston portion 16 there is arranged a releasable coupling mechanism 107, an advantageous constructional embodiment of which has been illustrated in FIG. 2. It consists of a number of balls or spherical members 19 arranged about the periphery 17*a* of the one piston portion 17, these balls 19 or the like being pressed by means of springs 20 or equivalent structure and the plungers 21 into the groove or groove means 22 terminating at an inclined or beveled surface 22*a* of the one piston portion 17. Each spring 20 is supported at a threaded ring or ring member 23. When the pressure in the pump compartment 6b has reached a predetermined value then by virtue of the action of the inclined surfaces 22*a* of the groove 22 the balls 19 are displaced out of the groove 22 against the action of the spring-loaded plungers 21 and the connection between the one piston portion 17 and the second piston portion 16 is released. When a plunger 21 is displaced by the associated ball 19 in the direction of the wall 6a of the pump cylinder 6 then a brake ring 24 constitutes a second coupling mechanism 108 and arranged between the plunger 21 and the pump cylinder 6 is frictionally pressed towards the pump cylinder 6 i.e. the pump cylinder wall 6*a* and blocks the second piston portion 16 in the pump cylinder, as the same has been shown at the right-hand portion of FIG. 2. The one piston portion 17 continues its pumping movement or action until reaching its terminal or end position.

During a cut-on movement starting from the position of the pump portions 16, 17 shown at the right-hand side of FIG. 2 the one piston portion 17 is initially retracted by the drive means. As soon as the groove 22 is located in front of the balls 19 then each ball 19 is pressed by means of the action of the associated spring-loaded plunger 21 into the groove 22, and both piston portions 16, 17 are positively coupled with one another. In order to be able to positively entrain the second piston portion 16 which is fixedly held by means of the brake ring or ring member 24 at the pump cylinder 6 there are mounted at the periphery of the second piston portion 16 a number of entrainment brackets 25 or equivalent structure.

Figure 3:
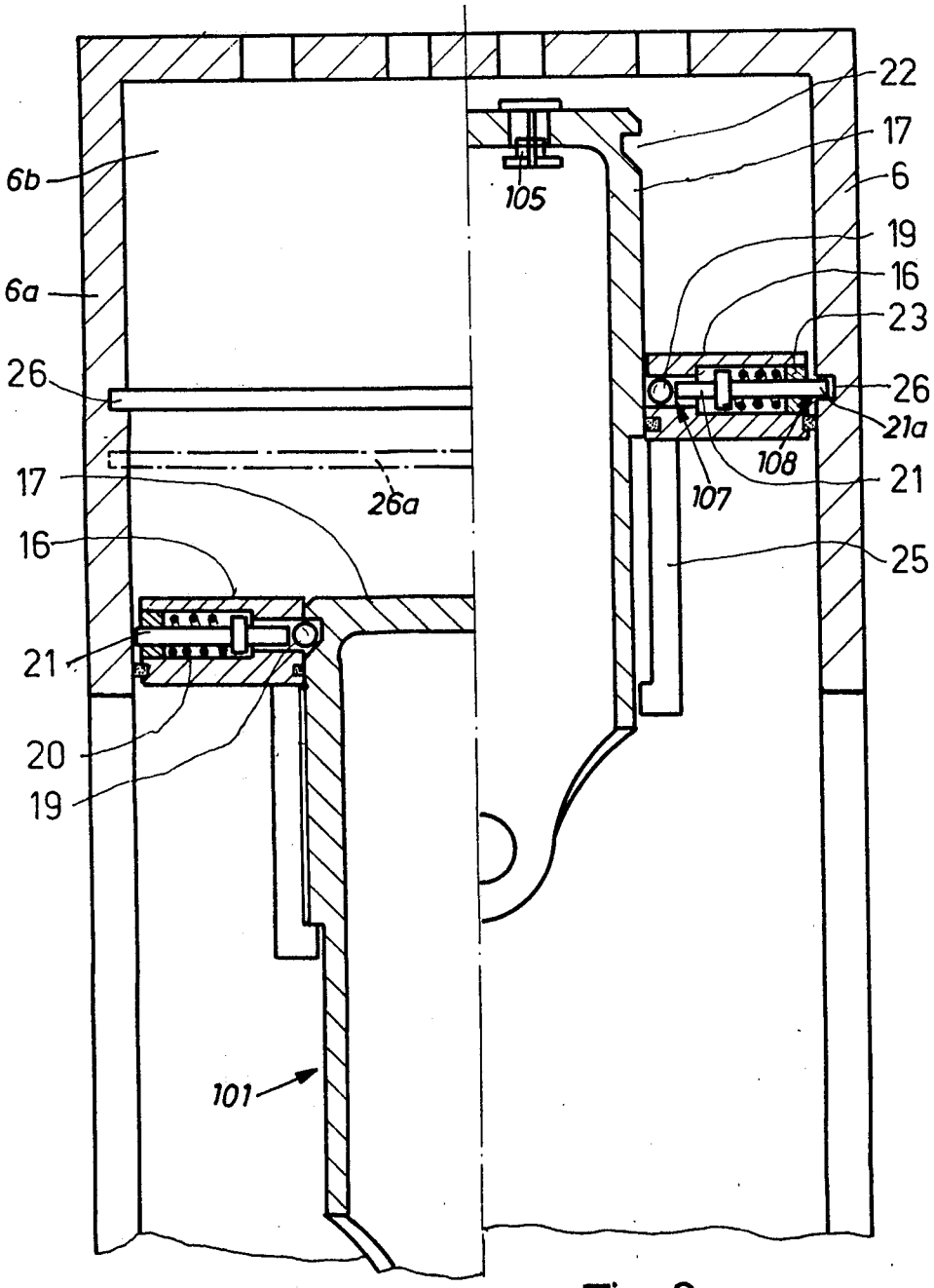
FIG. 3 is a fragmentary sectional view of a second construction of pump device.

In FIG. 3 there is illustrated an arrangement of the pump device 101 similar to that illustrated in FIG. 2. Hence, as a matter of convenience corresponding components have been generally designated with the same reference characters as have been employed in the constructional embodiment of FIG. 2. With the arrangement shown in FIG. 3 the coupling mechanism 107 which is installed between the one piston portion 17 and the second piston portion 16 only then can be released with an excess pressure prevailing in the pump compartment 6a of the pump cylinder 6 which exceeds a given limit or boundary and when the plunger 21 can be pushed into a groove 26 provided in the wall 6a of the pump cylinder 6. It is possible to arrange a number of grooves 26 behind one another in the wall 6a of the pump cylinder 6, as schematically indicated by reference character 26a. With this arrangement the second piston portion 16 only can be fixedly held at the locations in the pump cylinder determined by the grooves 26 due to the coupling action of the end 21a of the plunger 21 with such grooves 26 and defining the coupling mechanism 108.

Figure 4:
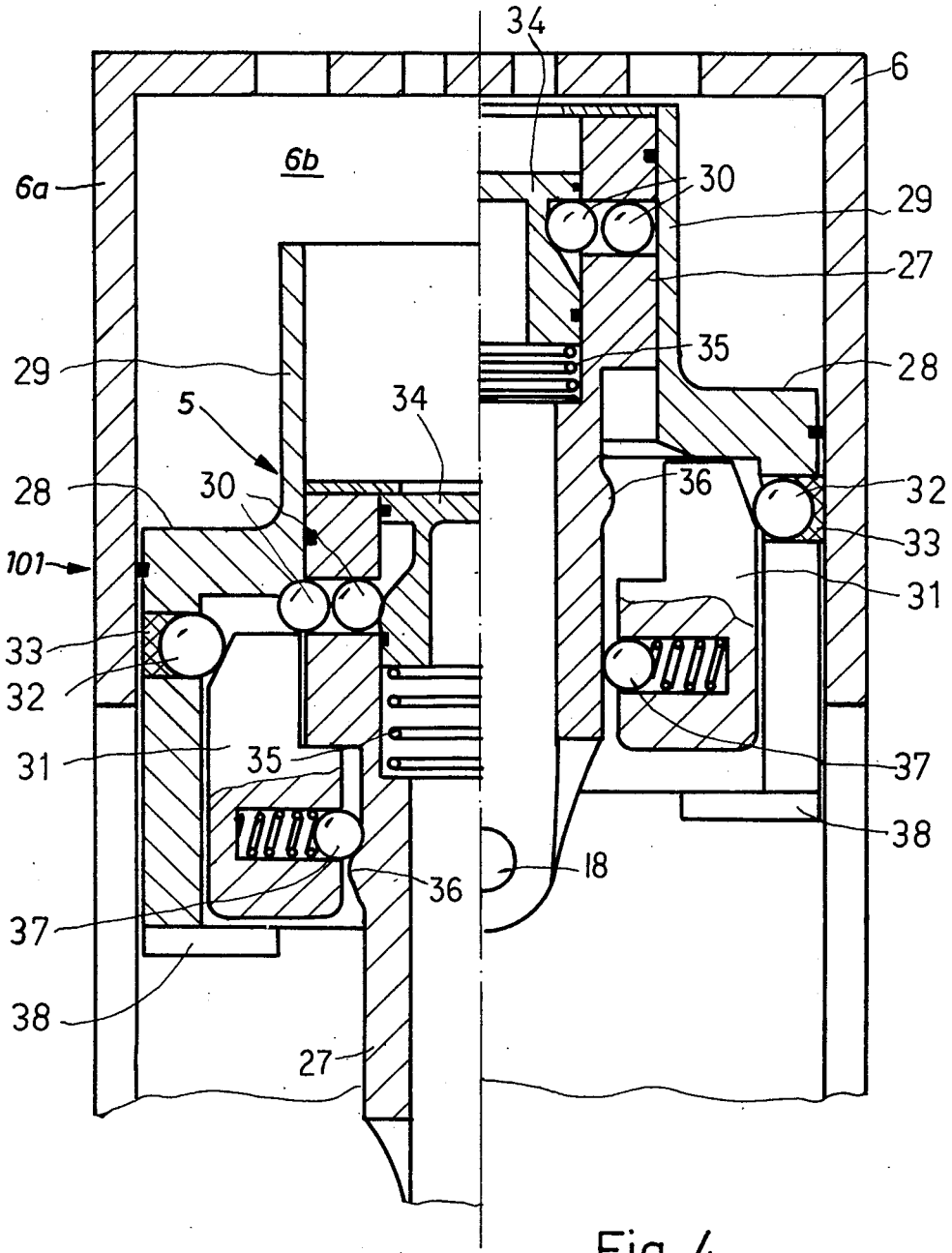
FIG. 4 is a fragmentary sectional view of a third construction of pump device

Continuing, with the variant construction of pump device 101 shown in FIG. 4 the therein illustrated piston or piston member 5 possesses three sections or portions 27, 28 and 34. The one piston portion 27 is positively coupled with the drive means which has not here been shown to preserve clarity in illustration, but may be like the drive means 2, 100 of the previously discussed arrangements. The second piston portion 28 is provided with a collar 29 serving as the cylinder for the one or first portion 27 and is either coupled with the one piston portion 27 by means of balls 30 or equivalent structure or with the pump cylinder 6 by means of the slide or slide member 31, balls 32 and friction brake ring or ring member 33 engageable with the cylinder wall 6a. The third piston portion or section 34 is constituted by a spring-loaded pressure measuring piston. When the pressure in the pump compartment or chamber 6b of the pump cylinder 6 exceeds a value which is above a predetermined or pre-selected boundary or limit, then the pressure measuring piston 34 is pressed back against the force of the spring 35 and the coupling is released between the one piston portion 27 and the second piston portion 28 because the balls 30 are inwardly displaced. Hence, there is freed a path of movement for the slide or slide member 31. This slide 31 is entrained by the piston portion 27 with the aid of a bulging portion or protuberance 36 and the spring-loaded ball 37, and the brake ring 33 is tensioned or loaded via the balls 32. During retraction of the piston the brake is released and the second piston portion 28 is entrained by the first piston portion or section 27 with the aid of the entrainment bracket or bracket means 38 and the slide 31. If during the cut-off movements of the gas-blast switch the pressure in the pump cylinder does not exceed the adjusted boundary or limit, then the first piston portion 27 and the second portion 28 are conjointly forwardly displaced. In this case the collar 29 is pushed into the nozzle into a space or compartment which is formed for this purpose.

A particular advantage of the invention is that both upon interruption or cut-off of relatively small currents and also upon interruption or cut-off of the largest permissible currents for the gas-blast switch there is possible an adequate blowing of the arc with relatively small drive energy.

While there is shown and described preferred embodiments of the invention it is to be distinctly understood that the invention is not limited thereto, but may be otherwise variously embodied and practiced within the scope of the following claims.

Accordingly, What is claimed is:

1. A gas-blast switch comprising two contact elements which can be brought into and out of engagement with one another, drive means for actuating at least one of the contact elements, a pump device actuatable during the switching movements of the gas-blast switch, said pump device comprising a piston and cylinder, said cylinder including a pump compartment, a nozzle, an exhaust compartment flow communicating with said nozzle, said pump device during cut-off movements of the gas-blast switch delivering an extinguishing agent out of the pump compartment through the nozzle into the exhaust compartment, said nozzle being constructed to take-up a switching arc which is formed between the separating contact elements, said piston comprising a number of piston portions which are guided in a gastight manner for relative movement within one another and dividing a piston surface of the piston which confronts the pump compartment, one of the piston portions defining a first piston portion which is positively connected with the drive means, a respective releasable coupling mechanism arranged between the first piston portion positively connected with the drive means and a second piston portion and between such second piston portion and the pump cylinder, said coupling mechanisms upon cut-off of the gas-blast switch and as a function of the pressure difference between the pump compartment and the exhaust compartment selectively positively connecting the second piston portion either with the first piston portion below a pre-selected excess pressure limit prevailing in the pump compartment or the second piston portion with the pump cylinder when there prevail pressure values which are above the pre-selected limit.

2. The gas-blast switch as defined in claim 1, further including means for rendering the release of the coupling connection between the first piston portion and the second piston portion and the establishment of the coupling connection between the second piston portion and the pump cylinder at a predetermined location in the pump cylinder as a function of the pressure prevailing in the pump compartment.

3. The gas-blast switch as defined in claim 1, further including means for rendering the release of the coupling connection between the first piston portion and the second piston portion and the establishment of the coupling connection between the second piston portion and the pump cylinder at random locations of the pump cylinder as a function of the pressure prevailing in the pump compartment.

4. The gas-blast switch as defined in claim 1, wherein said piston further includes a third piston portion which in the case of pressure values prevailing in the pump compartment which are above the pre-selected excess pressure limit releases the coupling mechanism between the first piston portion and the second piston portion and brings into engagement the coupling mechanism between the second piston portion and the pump cylinder.

5. The gas-blast switch as defined in claim 4, wherein said third piston portion comprises a spring-loaded pressure measuring piston.

6. The gas-blast switch as defined in claim 1, wherein at least one of the coupling mechanisms comprises a ball locking means.

7. The gas-blast switch as defined in claim 1, wherein at least one of the coupling mechanisms comprises a friction brake.

* * * * *